US008989566B2

(12) United States Patent
Liu et al.

(10) Patent No.: US 8,989,566 B2
(45) Date of Patent: Mar. 24, 2015

(54) HEATING PUMP

(71) Applicant: Johnson Electric S.A., Murten (CH)

(72) Inventors: Li Sheng Liu, Shenzhen (CN); Yue Li, Hong Kong (CN); Hong Jian Zhang, Shenzhen (CN); Jian Hong Wu, Shenzhen (CN)

(73) Assignee: Johnson Electric S.A., Murten (CH)

( * ) Notice: Subject to any disclaimer, the term of this patent is extended or adjusted under 35 U.S.C. 154(b) by 223 days.

(21) Appl. No.: 13/661,925

(22) Filed: Oct. 26, 2012

(65) Prior Publication Data

US 2013/0108252 A1 May 2, 2013

(30) Foreign Application Priority Data

Oct. 28, 2011 (CN) ..... 2011 1 0333673

(51) Int. Cl.

| | |
|---|---|
| ***F24H 1/08*** | (2006.01) |
| ***F04D 13/06*** | (2006.01) |
| ***F04D 29/42*** | (2006.01) |
| ***F04D 29/58*** | (2006.01) |

(52) U.S. Cl.

CPC ..... *F04D 13/06* (2013.01); *F04D 29/426* (2013.01); *F04D 29/588* (2013.01)

USPC ..... 392/471; 392/465; 392/480

(58) Field of Classification Search

None

See application file for complete search history.

(56) References Cited

U.S. PATENT DOCUMENTS

| | | | | | |
|---|---|---|---|---|---|
| 1,562,240 | A * | 11/1925 | Melotti | 123/142.5 R |
| 4,300,870 | A * | 11/1981 | Cox et al. | 417/53 |
| 4,349,434 | A * | 9/1982 | Jaworski | 210/94 |
| 4,594,500 | A * | 6/1986 | Wright | 392/471 |
| 5,408,960 | A * | 4/1995 | Woytowich | 123/142.5 E |
| 5,701,388 | A * | 12/1997 | Steinhardt et al. | 392/471 |
| 6,454,523 | B1 * | 9/2002 | Loyd et al. | 415/58.4 |
| 7,144,504 | B2 * | 12/2006 | Tsai | 210/416.2 |
| 7,287,536 | B2 * | 10/2007 | Steck et al. | 134/107 |
| 7,293,958 | B2 * | 11/2007 | Kraffzik | 415/206 |
| 8,245,718 | B2 * | 8/2012 | Busing et al. | 134/108 |
| 2008/0044168 | A1 * | 2/2008 | Eichholz et al. | 392/471 |

* cited by examiner

*Primary Examiner* — Thor Campbell

(74) *Attorney, Agent, or Firm* — Muncy, Geissler, Olds & Lowe, P.C.

(57) ABSTRACT

A heating pump includes a motor, a housing fixed to the motor, an impeller driven by the motor and received in the housing, and a tubular heating member fixed in the housing. The housing includes an intake tube and a discharge port arranged at the periphery of the intake tube. The impeller includes an inlet communicating with the intake tube and a plurality of outlets around the inlet. The outlets communicate with the discharge port via a first passage surrounded by the heating member. A second passage, which communicates with the first passage, is formed between a radially outer surface of the heating member and a radially inner surface of the housing.

23 Claims, 5 Drawing Sheets

HEATING PUMP

CROSS REFERENCE TO RELATED APPLICATIONS

This non-provisional patent application claims priority under 35 U.S.C. §119(a) from Patent Application No. 201110333673.5 filed in The People's Republic of China on Oct. 28, 2011.

FIELD OF THE INVENTION

This invention relates to heating pumps and particularly, to a heating pump having high heating efficiency.

BACKGROUND OF THE INVENTION

A heating pump is a pump with a build-in heater to heat liquid being pumped. An existing heating pump includes a housing, an impeller received in the housing, a motor to drive the impeller and a heater fixed to an interior surface of the housing. In operation, liquid entering the housing via an inlet, is forced against the heater by the impeller and finally expelled through an outlet of the housing. In this process, the liquid is heated as it contacts the heater and therefore leaves the pump with an elevated temperature. However, only the heat from the inner surface of the heating tube is absorbed by the liquid, the heat radiating from the outer surface is wasted. This results in a heating pump with a low heating efficiency.

The present invention aims to provide a new heating pump which can solve or at least mitigate the above mentioned problem.

SUMMARY OF THE INVENTION

Accordingly, in one aspect thereof, the present invention provides a heating pump, comprising: a motor; a housing fixed to the motor, the housing comprising an axially arranged intake tube and a discharge port arranged at the periphery thereof; an impeller driven by the motor and received in the housing, the impeller comprising an axially arranged inlet communicating with the intake tube and a plurality of radially arranged, circumferentially spaced, outlets; and a tubular heating member fixed in the housing; a first passage surrounded by the heating member, the outlets communicating with the discharge port via the first passage; and a second passage formed between a radially outer surface of the heating member and a radially inner surface of the housing and communicating with the first passage.

Preferably, the first passage is formed between a radially outer surface of the intake tube and a radially inner surface of the heating member.

Preferably, the housing further comprises a plurality of guide blades disposed in the first passage to guide liquid to flow through the first passage along a spiral path.

Preferably, the housing further comprises an end surface at an axial end thereof remote from the motor and a recess formed in the end surface, and wherein the intake tube is received in the recess, and the first passage is formed between a radially inner surface of the heating member and a radially outer surface of the end surface that surrounds the recess.

Preferably, an inner diameter of the intake tube gradually becomes smaller in a direction towards the impeller.

Preferably, an inner end of the intake tube facing the impeller is contoured and a part of the impeller extends into the inner end of the intake tube.

Preferably, the outlets further communicate with the discharge port via the second passage.

Preferably, the housing further comprises a spiral rib protruding from an inner surface of the housing for guiding liquid to flow through the second passage along a spiral path.

Preferably, the housing further comprises an end ring partially sealing an axial end of the second passage remote from the motor, and a discharge aperture formed in the end ring, the second passage communicating with the discharge port via the discharge aperture.

Preferably, the housing further comprises a substantially cylindrical lateral wall, wherein the end ring extends radially inwards from an axial end of the lateral wall; the heating pump further comprises a circular plate fixed between the motor and the impeller and seals the other axial end of the lateral wall.

Preferably, the heating member is fixed to the end ring, and a gap is formed between the heating member and the circular plate in the axial direction; the first passage communicating with the second passage via the gap.

Preferably, the circular plate comprises an annular wall protruding towards the end ring, the annular wall comprises a first ring groove formed in a surface thereof that faces towards the end ring and a plurality of openings axially spaced from the first ring groove; the end ring comprising a second ring groove, the discharge aperture is arranged between the second ring groove and the lateral wall; two axial ends of the heating member are respectively received in the first and second ring grooves; and the first passage communicates with the second passage via the openings.

Preferably, the heating member comprises a metal tube and at least one resistor disposed within a wall of the metal tube.

Preferably, the heating member comprises a metal tube, at least one resistor running circumferentially on a radially outer surface of the metal tube, and a sealing element sealing the at least one resistor in a liquid-tight manner.

Preferably, the sealing element comprises a sealing tube that covers the radially outer surface of the metal tube and two axial ends that sealingly contact two axial ends of the metal tube.

Alternatively, the housing further comprises a substantially cylindrical lateral wall that is substantially parallel with an axis of the motor, the lateral wall comprises a through hole; the sealing element further comprises a extending ring extending from the sealing tube and extending through the through hole, and ends of the at least one resistor are exposed in the extending ring.

Preferably, the housing further comprises a fixing ring extending from an edge of the through hole, the extending ring is sealingly connected to the fixing ring.

Preferably, a connector is connected to the ends of the at least one resistor, and the connector is received in the extending ring and configured for connecting to a power source.

According to a second aspect thereof, the present invention provides a heating pump, comprising: a motor defining an axis of the pump; a housing fixed to the motor, the housing comprising: a cylindrical lateral wall extending coaxially and having an open first axial end and a closed second axial end, the first axial end disposed adjacent the motor, an axially arranged intake tube passing through the middle of the closed second axial end and a discharge port arranged at the periphery thereof; an impeller driven by the motor and received in the housing, the impeller comprising an axially arranged inlet communicating with the intake tube and a plurality of radially arranged outlets; a tubular heating member fixed in the housing; a first passage formed between a radially outer surface of the intake tube and a radially inner surface of the heating member; and a second passage formed between a radially outer surface of the heating member and a radially inner surface of the housing, wherein the outlets communicate with the discharge port via the first and second passages.

According to a third aspect thereof, the present invention provides a heating pump, comprising: a motor; a housing fixed to the motor, the housing comprising an end surface at an axial end thereof that is remote from the motor, a recess formed in the end surface, an axially arranged intake tube received in the recess, and a discharge port arranged at the periphery thereof; an impeller driven by the motor and received in the housing, the impeller comprising an axially arranged inlet communicating with the intake tube and a plurality of radially arranged outlets radially surrounding the inlet; and a tubular heating member fixed in the housing; a first passage formed between a radially inner surface of the heating member and a radially outer surface of the end surface that surrounds the recess; and a second passage formed between a radially outer surface of the heating member and a radially inner surface of the housing, wherein the outlets communicate with the discharge port via the first and second passages.

In embodiments of the present invention, as both sides of the tubular heating member contact liquid passing through the housing, heat from both radial sides of the heating member is absorbed. Compared to a heating pump that has only the radially inner side in contact with the liquid, the heating pump of the present invention has a higher heating efficiency.

BRIEF DESCRIPTION OF THE DRAWINGS

Embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
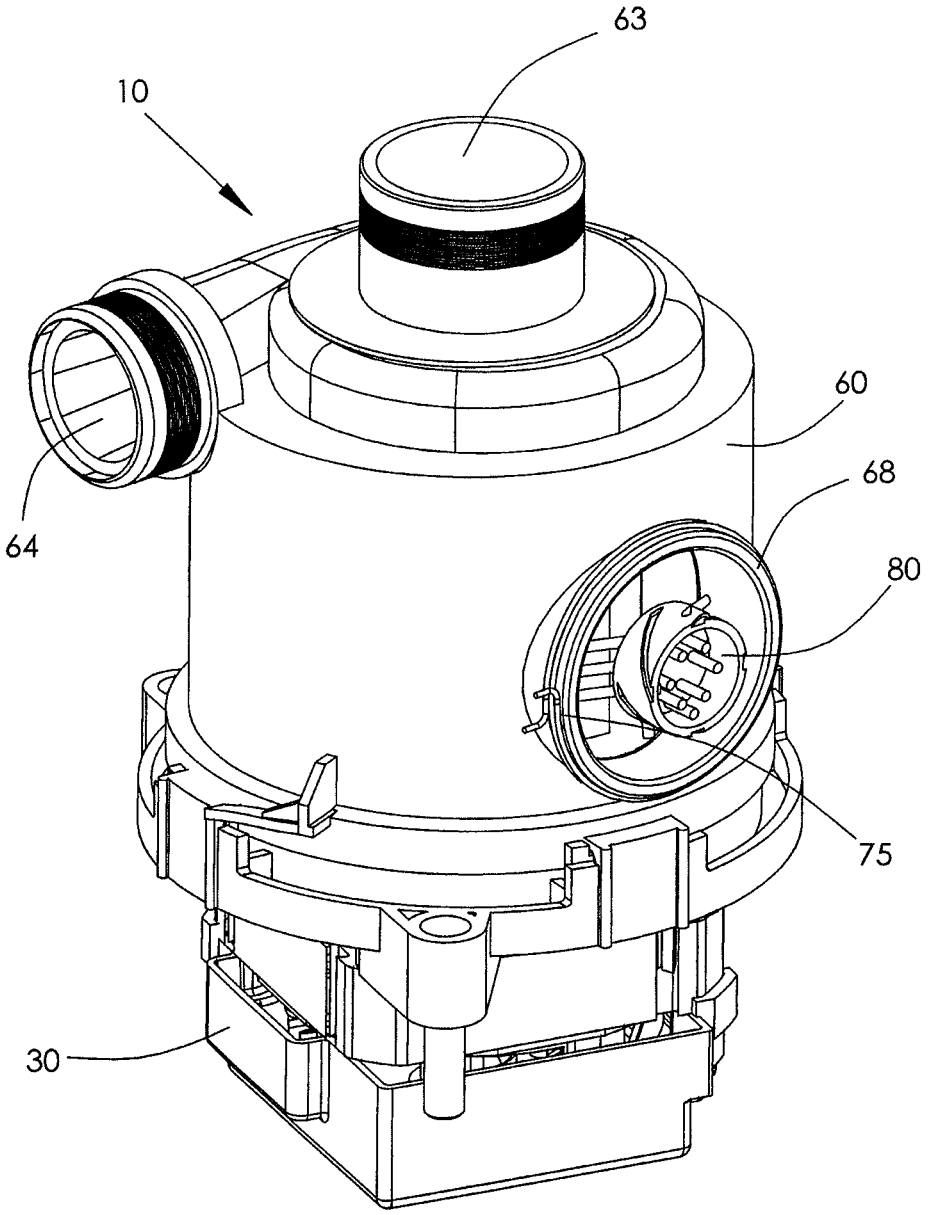
FIG. 1 illustrates a heating pump according to a preferred embodiment of the present invention.
Figure 2:
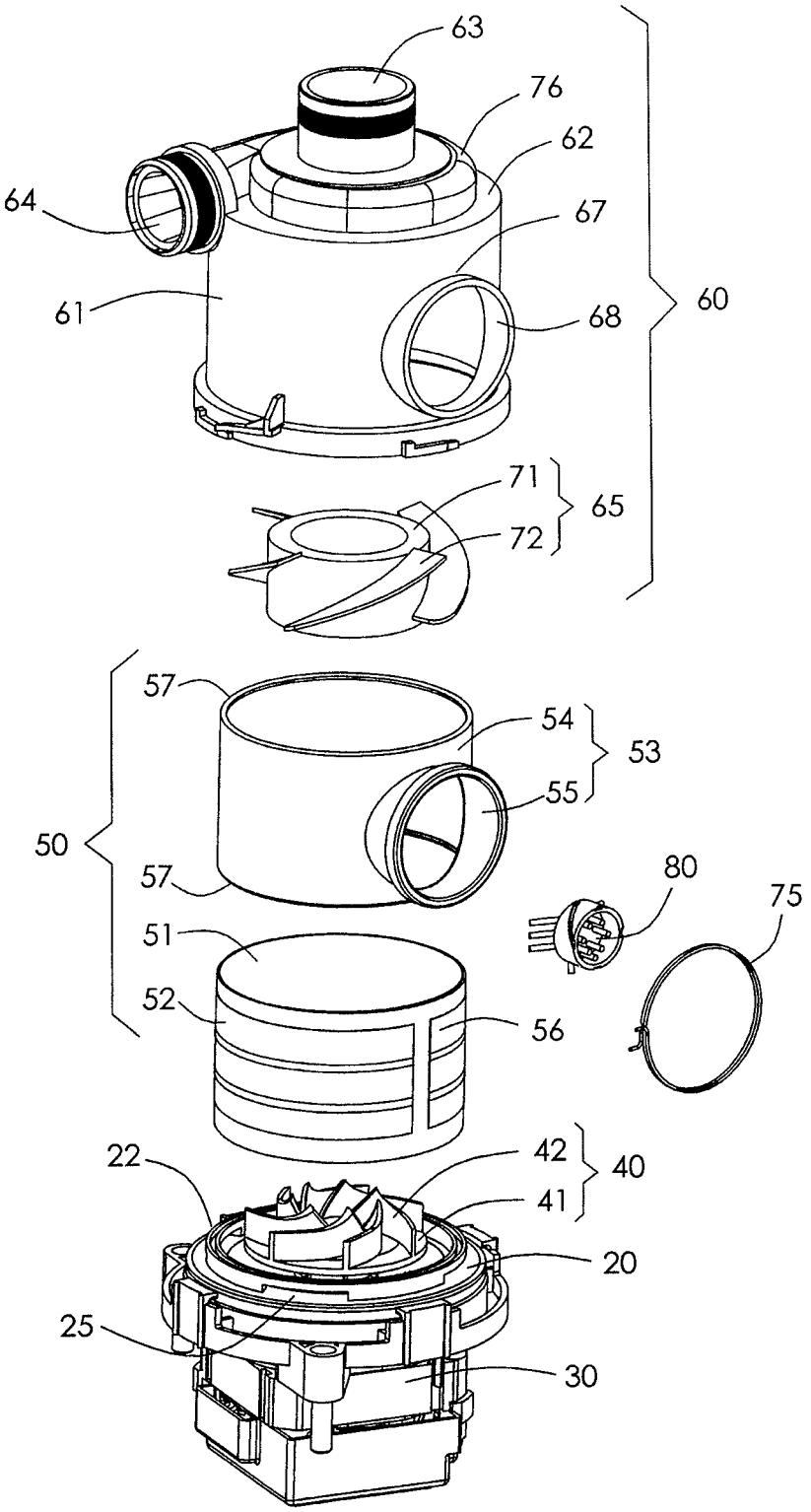
FIG. 2 is a partially exploded view of the heating pump of FIG. 1.

Referring firstly to FIGS. 1 to 5, a heating pump 10, according to the preferred embodiment of the present invention, includes a base 20, a motor 30, an impeller 40, a heating member 50, a housing 60, and a connector 80.

Figure 4:
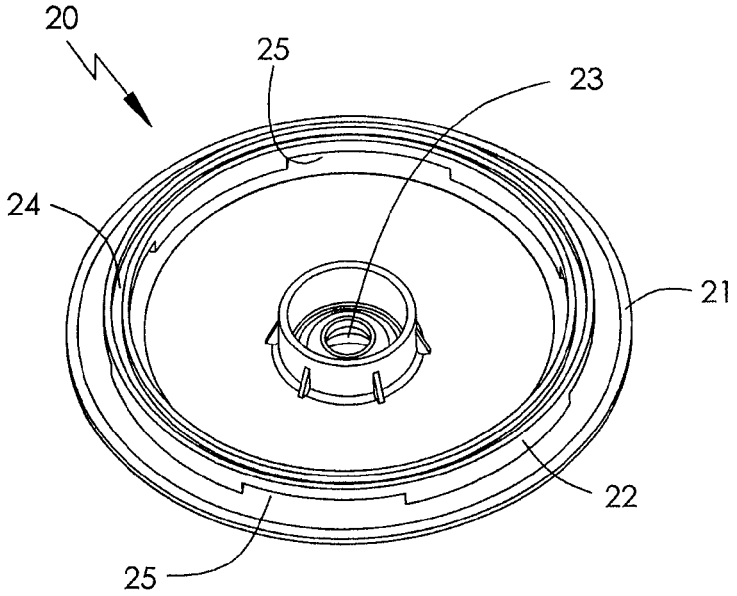
FIG. 4 illustrates a base of the heating pump of FIG. 1.

The base 20, as more clearly shown in FIG. 4, includes a circular plate 21 and an annular wall 22. The circular plate 21 has a shaft hole 23 at the center thereof. The annular wall 22 extends axially from the circular plate 21 at a location near the edge of the circular plate 21 and is generally coaxial with the shaft hole. The annular wall 22 has a first ring groove 24 formed in the top surface of the annular wall. The annular wall 22 also defines a number of openings 25 that pass radially through the annular wall. Preferably, the openings 25 are spaced apart from the first ring groove 24 in the axial direction of the circular plate 21, so that the openings 25 do not communicate with the first ring groove 24. The motor 30 is detachably connected to the base 20, with the shaft thereof passing through the shaft hole 23 and a liquid-tight sealing ring (not shown) sealing the shaft to the base. It should be understood that the base 20 can be integrally formed with an end cap of the motor 30. In this case, the housing 60 can be directly connected to the motor 30. Also, it is possible for the openings 25 to completely separate the annular wall into a number of sections such that the annular wall 22 is intermittent.

The impeller 40 is fixed to the shaft of the motor 30 with the annular wall 22 radially surrounding the impeller. The impeller 40 is of the centrifugal type, including a lower cover 41, a number of blades 42 extending from the cover 41, an inlet 43 formed by the radially inner ends of the blades, and a number of outlets 44 located at the periphery thereof. The blades 42 are curved in the radial direction of the impeller 40. The inlet 43 communicates with the spaces between the radially inner ends of adjacent blades 42. Each outlet 44 is formed between the radially outer ends of adjacent blades 42. As shown, the diameter of the inlet 43 gradually becomes smaller in a direction towards the motor, due to the radially inner ends of the blades being axially inclined.

The heating member 50 includes a metal tube 51, a number of thick-film resistors 52, and a sealing element 53. The thick-film resistors 52 are formed on a surface of the metal tube 51, running circumferentially and spaced apart from one another. Alternatively, the resistors may follow a serpentine or zig zag path. Preferably, the resistors 52 are formed on the outer surface of the metal tube by a printing process. The sealing element 53 may be made of rubber, including a sealing tube 54 that covers the outer surface of the metal tube 51 and an extending ring 55 extending from the sealing tube 54. Two axial ends 57 of the sealing tube 54 are sealed to the metal tube. Preferably, as shown in Fig. X, the axial ends of the sealing tube wrap around the axial ends of the metal tube to seal the sealing tube to the metal tube. The ends may be bonded together by adhesive, heat, etc or clamped or otherwise pressed together to form a seal by compression. The connecting ends 56 of the thick-film resistors 52 are exposed in an opening formed by the extending ring 55.

The housing 60 is substantially barrel-shaped, including a substantially cylindrical lateral wall 61, an end ring 62 extending radially inward from an axial end of the lateral wall 61, an intake tube 63 extending along the axis of the lateral wall 61, a guide portion 76 extending from the inner edge of the end ring 62 and connecting to the intake tube 63, a discharge port 64 extending from the guide portion 76 substantially along a direction tangential to the lateral wall 61, and a guide mechanism 65. The lateral wall 61 has a through hole 67. A fixing ring 68 extends outwardly from the edge of the through hole 67. A second ring groove 69 is formed in the end ring 62, radially spaced from the lateral wall 61. A discharge aperture 70 is formed in the end ring 62, between the second ring groove 69 and the lateral wall 61. The discharge aperture 70 communicates with the discharge port 64.

The lateral wall 61, the end ring 62, and the guide portion 76 jointly define a chamber 66 that communicates to the space outside the housing 60 through the intake tube 63, the discharge port 64, and the through hole 67. The intake tube 63 is partially received at the center of the chamber 66. The inner diameter of the intake tube 63 gradually becomes smaller from a region corresponding to the upper end of the housing towards the impeller, while at the end 73 of the intake tube 63 adjacent the impeller, the inner diameter of the intake tube 63 becomes larger. This increase in diameter is formed as a tapering or chamfering of the inner end of the intake tube so as to provide a restriction to the flow of the liquid being pumped from the outlet to the inlet of the impeller. Preferably, the inner end 73 of the intake tube generally follows the contour of the upper surface of the impeller or impeller blades. However, some cross flow is allowed to reduce friction and load on the motor when the outlet is blocked. The inlet 43 of the impeller 40 points toward the intake tube 63, while a part of the inlet 43 is received in the distal end 73 of the intake tube 63 to reduce axial length of the heating pump 10. The discharge port 64 is substantially arranged at a side of the end ring 62 that is opposite to the lateral wall 61.

The guide mechanism 65 includes a ring 71 and a number of angled guide blades 72 extending radially outward from the ring 71 and axially along the ring. The ring 71 is pressed onto the inner end of the intake tube 63 such that it sits in a fixed manner. Preferably, the lateral wall 61, end ring 62, intake tube 63, and discharge port 64 are formed as a single piece, monolithic construction, for example, by injection molding. Preferable, the guide mechanism 65 is formed as a separate piece, also by injection molding, and subsequently fitted to the intake tube. However, it should be understood that the guide blades 72 can also be integrally formed with the intake tube 63.

The housing 60 is detachably assembled to the base 20. The edge of the circular plate 21 tightly contacts the inner surface of the lateral wall 61, so that the circular plate 43 can seal the open end of the chamber 66 remote from the end ring 62. The two axial ends of the heating member 50 are respectively inserted into the first and second receiving grooves 24 and 69. The axial ends 57 of the sealing tube 54 are thus pressed against the inner and outer surfaces of the axial ends of the metal ring 51, whereby the heating member 50 is connected to the base 20 and the housing 60 in a liquid-tight manner. The extending ring 55 extends out of the fixing ring 68 and is sealingly connected thereto, for example, by a spring clamp 75 or glue. The connector 80 is electrically connected to the connecting ends 56 of the thick-film resistors 52 and is housed in the opening formed by the extending ring 55.

In operation, the impeller 40 sucks liquid into the chamber 66 via the intake tube 63 and discharges it radially outwards as a result of centrifugal force. The moving speed of the liquid flow is accelerated due to the inner diameter gradually becoming smaller. The guide blades 72 of the guide mechanism 65 then transfer part of rotary motion of the liquid flow into vertical motion. Therefore, the liquid flows to the discharge port 64 in a spiral way through a first passage 12 formed between the inner surface of the heating member 50 and the outer surface of the intake tube 63. During this process, the liquid contacts the inner surface of the metal tube 51 being heated by the thick-film resistors 52 and is heated to a desired temperature. At the same time, liquid ejected from the impeller 40 passes through the openings 25 of the base 20, into a second passage 14 formed between the outer surface of the heating member 50 and the inner surface of the lateral wall 61, passes through the discharge aperture 70 and into the discharge port 64 to be discharged. Since the outer surface of the heating member 50 is also heated by the thick-film resistors 52, the liquid flowing through the second passage is also heated. As such, the heat efficiency is improved.

In the case that the discharge aperture 70 on the housing 60 is omitted, liquid can still flow into the second passage 14 where it is heated. A temperature drop then exists between liquid in the second passage 14 and liquid coming freshly from the impeller 40, which causes the relatively hot water in the second passage 14 to flow back to the first passage 12. Therefore, it should be understood that the heat efficiency can also be improved even the discharge aperture 70 is omitted.

Figure 3:
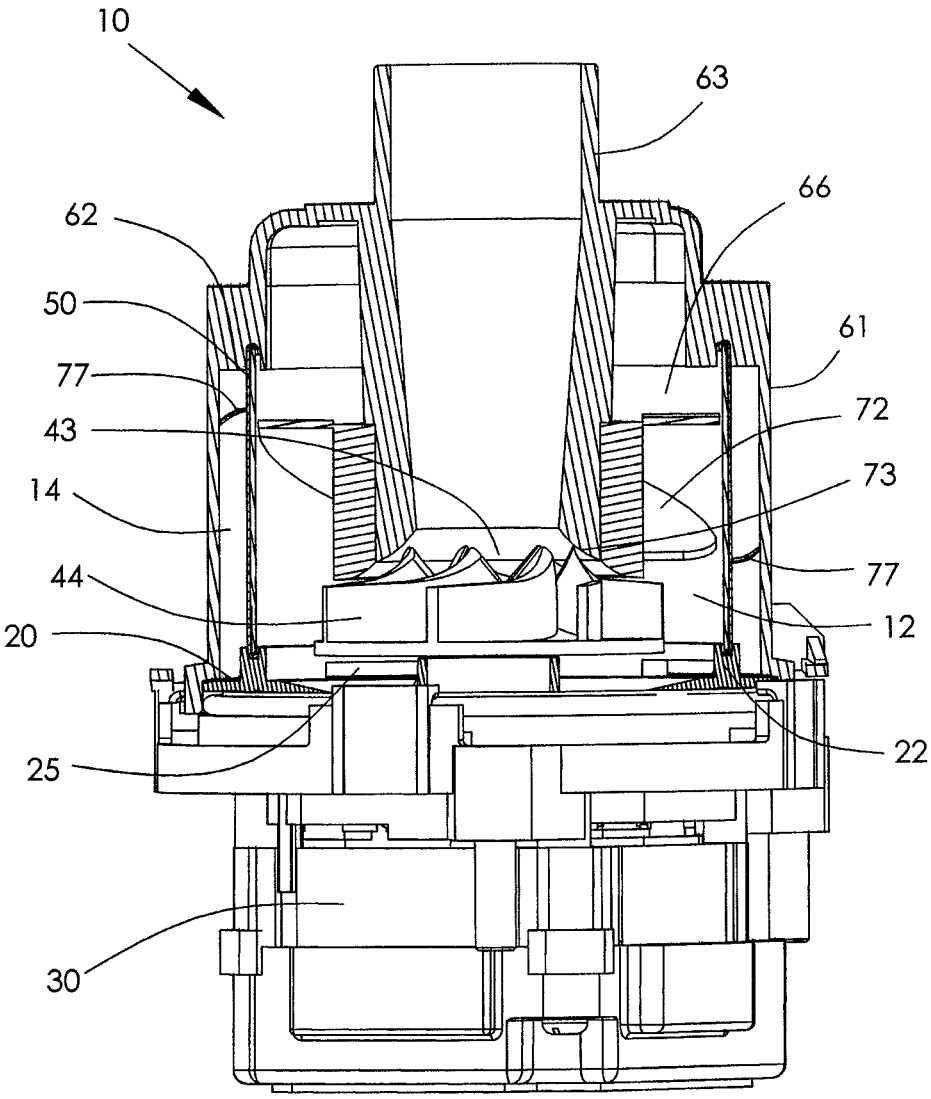
FIG. 3 illustrates a partial longitudinal section through the heating pump of FIG. 1.
Figure 5:
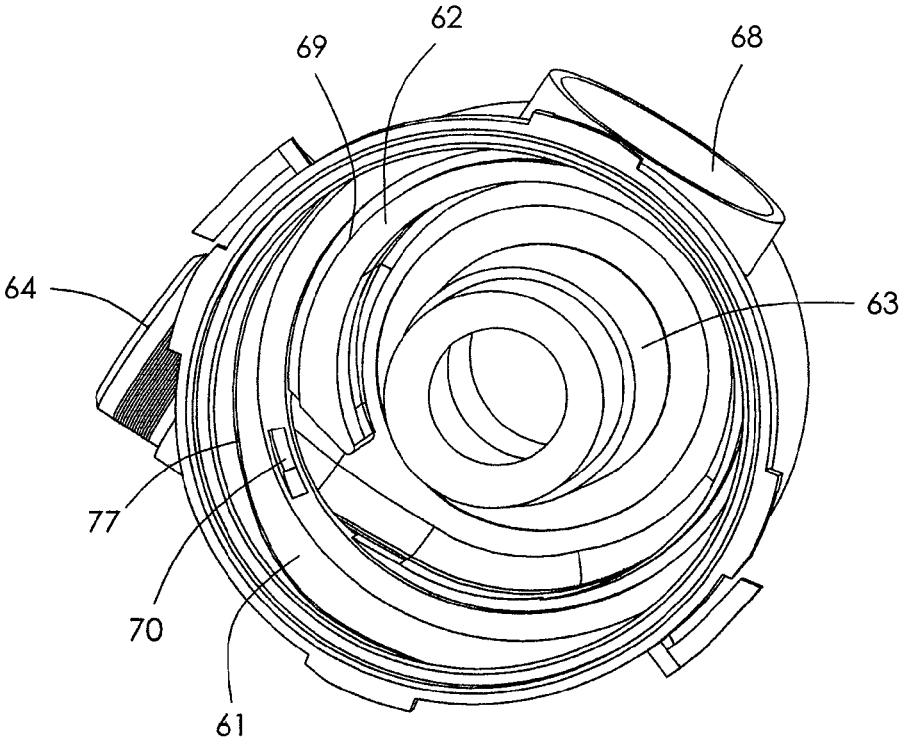
FIG. 5 illustrates a housing of the heating pump of FIG. 1.

Preferably, as shown in FIGS. 3 and 5, the housing 60 further includes a spiral rib 77 protruding from the inner surface of the lateral wall 61 for guiding the liquid in the second passage 14 to flow to the discharge port 64 in a spiral way. In this case, since liquid flows in both first and second passages 12, 14 in a spiral way, the time both liquid flows remain in contact with the heating member 50 is relatively longer, compared to the liquid flows passed the heating member 50 in a straight line.

Figure 6:
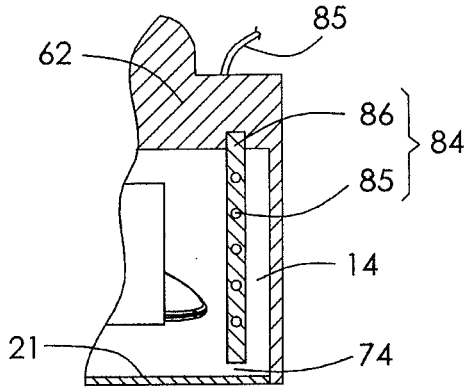
FIG. 6 is a partial view of a longitudinal section through a heating pump according to a second embodiment of the present invention, showing a heating member, a housing, and a circular plate.

Referring to FIG. 6, in other embodiments, the heating member 84 may include ring-shaped wire resistors 85 other than thick-film resistors 52. The wire resistors 85 may be arranged within the metal tube 86. In this case, the connectors of the wire resistors 85 can extend directly out of the end ring 62 for connecting to a power source. The sealing element 53, the through hole 67, and the fixing ring 68 can be omitted. This is especially easy if the housing is directly molded to the heating member 84.

The annular wall 22 is configured for assembling the heating member 50 in a convenient way. However, referring to FIG. 6, it should be understood that the heating member 84 can also be just fixed to the end ring 62, for example, by glue or welding, leaving a gap 74 between the other axial end of the heating member 84 and the circular plate 21. Liquid can thus flow into the second passage 14 via the gap 74.

Figure 7:
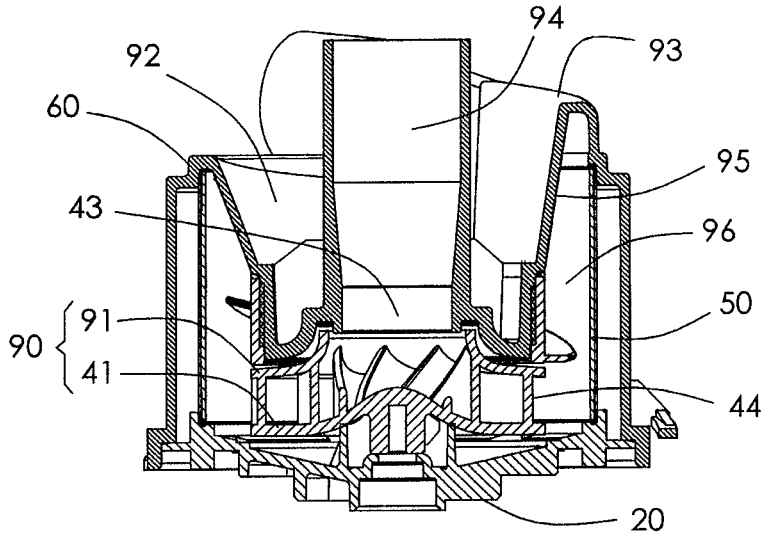
FIG. 7 is a longitudinal sectional view of a heating pump without a motor, according to a third embodiment of the present invention.

Referring to FIG. 7, the impeller 90 may be a centrifugal impeller with two covers, a lower cover 41 and an upper cover 91, defining the inlet 43 and the outlet 44. The upper cover 91 is contoured and closely spaced from the inner end of the intake tube.

Figure 8:
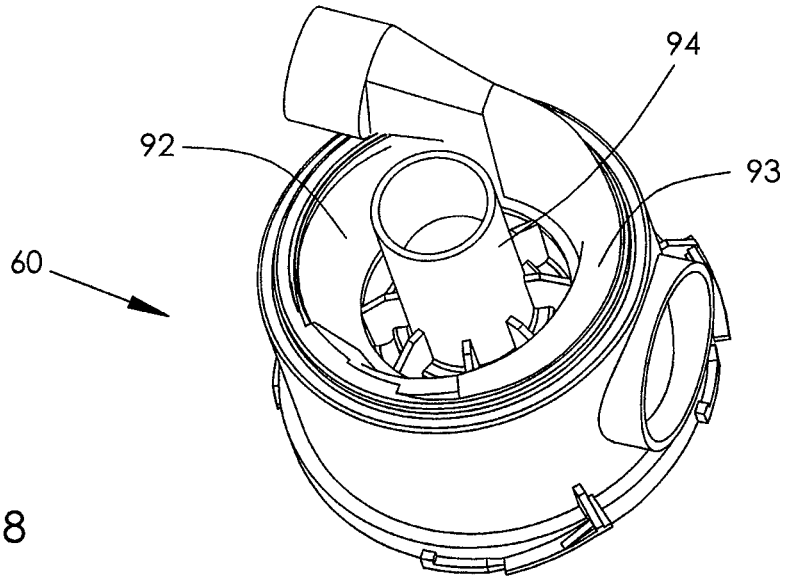
FIG. 8 illustrates a housing of the heating pump of FIG. 7.

Referring to FIGS. 7 and 8, in other embodiments, the housing may be formed with a recess 92 in the upper end surface 93. The intake tube 94 is received in the recess 92. In this case, the inner surface of the heating member 50 and the radial outer surface 95 of the end surface 93 that surrounds the recess 92 cooperatively form a first passage 96 that performs the same function as the first passage 12. Like the first passage 12, the first passage 96 is also surrounded by the heating member 50.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A heating pump, comprising:

a motor;

a housing fixed to the motor, the housing comprising a substantially cylindrical lateral wall, a discharge port arranged at the periphery thereof at a side of the housing away from the motor, and an axially arranged intake tube extending inside a space surrounded by the lateral wall nearer to the motor comparing to the discharge port;

an impeller driven by the motor and received in the housing, the impeller comprising an axially arranged inlet communicating with the intake tube and a plurality of radially arranged, circumferentially spaced, outlets, and used for sucking liquid into a chamber defined inside the housing via the intake tube and discharging it radially outwards;

a tubular heating member fixed in the housing;

a first passage surrounded by the heating member, the outlets communicating with the discharge port via the first passage; and a second passage formed between a radially outer surface of the heating member and a radially inner surface of the housing and communicating with the first passage;

wherein a number of guide blades are received in the first passage and configured to transfer part of rotary motion of a liquid flow generated by the impeller into vertical motion, leading the liquid flows from an end of the heating member near the motor to an opposite end of the heating member away from the motor in a spiral way through the first passage and finally to the discharge port.

2. The heating pump of claim 1, wherein the first passage is formed between a radially outer surface of the intake tube and a radially inner surface of the heating member.

3. The heating pump of claim 1, wherein the housing further comprises an end surface at an axial end thereof remote from the motor and a recess formed in the end surface, and wherein the intake tube is received in the recess, and the first passage is formed between a radially inner surface of the heating member and a radially outer surface of the end surface that surrounds the recess.

4. The heating pump of claim 1, wherein an inner diameter of the intake tube gradually becomes smaller in a direction towards the impeller.

5. The heating pump of claim 1, wherein an inner end of the intake tube facing the impeller is contoured and a part of the impeller extends into the inner end of the intake tube.

6. The heating pump of claim 1, wherein the outlets further communicate with the discharge port via the second passage.

7. The heating pump of claim 6, wherein the housing further comprises a spiral rib protruding from an inner surface of the housing for guiding liquid to flow through the second passage along a spiral path.

8. The heating pump of claim 6, wherein the housing further comprises an end ring partially sealing an axial end of the second passage remote from the motor, and a discharge aperture formed in the end ring, the second passage communicating with the discharge port via the discharge aperture.

9. The heating pump of claim 8, wherein the end ring extends radially inwards from an axial end of the lateral wall; the heating pump further comprises a circular plate fixed between the motor and the impeller and seals the other axial end of the lateral wall.

10. The heating pump of claim 9, wherein the heating member is fixed to the end ring, and a gap is formed between the heating member and the circular plate in the axial direction; the first passage communicating with the second passage via the gap.

11. The heating pump of claim 9, wherein the circular plate comprises an annular wall protruding towards the end ring, the annular wall comprises a first ring groove formed in a surface thereof that faces towards the end ring and a plurality of openings axially spaced from the first ring groove; the end ring comprising a second ring groove, the discharge aperture is arranged between the second ring groove and the lateral wall; two axial ends of the heating member are respectively received in the first and second ring grooves; and the first passage communicates with the second passage via the openings.

12. The heating pump of claim 1, wherein the heating member comprises a metal tube and at least one resistor disposed within a wall of the metal tube.

13. The heating pump of claim 1, wherein the heating member comprises a metal tube, at least one resistor running circumferentially on a radially outer surface of the metal tube, and a sealing element sealing the at least one resistor in a liquid-tight manner.

14. The heating pump of claim 13, wherein the sealing element comprises a sealing tube that covers the radially outer surface of the metal tube and two axial ends that sealingly contact two axial ends of the metal tube.

15. The heating pump of claim 13, wherein the lateral wall that is substantially parallel with an axis of the motor comprises a through hole; the sealing element further comprises a extending ring extending from the sealing tube and extending through the through hole, and ends of the at least one resistor are exposed in the extending ring.

16. The heating pump of claim 15, wherein the housing further comprises a fixing ring extending from an edge of the through hole, the extending ring is sealingly connected to the fixing ring.

17. The heating pump of claim 16 further comprising a connector connected to the ends of the at least one resistor, wherein the connector is received in the extending ring and is configured for connecting to a power source.

18. A heating pump, comprising:

a motor defining an axis of the pump;

a housing fixed to the motor, the housing comprising: a cylindrical lateral wall extending coaxially and having an open first axial end disposed adjacent the motor and a closed second axial end, a discharge port arranged at the periphery thereof at a side of the housing away from the motor, an axially arranged intake tube passing through the middle of the closed second axial end and extending inside a space surrounded by the lateral wall nearer to the motor comparing to the discharge port;

an impeller driven by the motor and received in the housing, the impeller comprising an axially arranged inlet communicating with the intake tube and a plurality of radially arranged outlets, and used for sucking liquid into a chamber defined inside the housing via the intake tube and discharging it radially outwards;

a tubular heating member fixed in the housing; and a first passage formed between a radially outer surface of the intake tube and a radially inner surface of the heating member; and a second passage formed between a radially outer surface of the heating member and a radially inner surface of the housing, wherein the outlets communicate with the discharge port via the first and second passages;

wherein a number of guide blades are received in the first passage and configured to transfer part of rotary motion of a liquid flow generated by the impeller into vertical motion, leading the liquid flows from an end of the heating member near the motor to an opposite end of the heating member away from the motor in a spiral way through the first passage and finally to the discharge port.

19. A heating pump, comprising:

a motor;

a housing fixed to the motor, the housing comprising a substantially cylindrical lateral wall, an end surface at an axial end thereof that is remote from the motor, a recess formed in the end surface, a discharge port arranged at the periphery thereof at a side of the housing away from the motor, and an axially arranged intake tube received in the recess and extending inside a space surrounded by the lateral wall nearer to the motor comparing to the discharge port;

an impeller driven by the motor and received in the housing, the impeller comprising an axially arranged inlet communicating with the intake tube and a plurality of radially arranged outlets radially surrounding the inlet, and used for sucking liquid into a chamber defined inside the housing via the intake tube and discharging it radially outwards;

a tubular heating member fixed in the housing; and a first passage and formed between a radially inner surface of the heating member and a radially outer surface of the end surface that surrounds the recess, and a second passage formed between a radially outer surface of the heating member and a radially inner surface of the housing, wherein the outlets communicate with the discharge port via the first and second passages;

wherein a number of guide blades are received in the first passage and configured to transfer part of rotary motion of a liquid flow generated by the impeller into vertical motion, leading the liquid flows from an end of the heating member near the motor to an opposite end of the heating member away from the motor in a spiral way through the first passage and finally to the discharge port.

20. A heating pump, comprising:

a motor;

a housing fixed to the motor, the housing comprising an axially arranged intake tube and a discharge port arranged at the periphery thereof;

an impeller driven by the motor and received in the housing, the impeller comprising an axially arranged inlet communicating with the intake tube and a plurality of radially arranged, circumferentially spaced, outlets;

a tubular heating member fixed in the housing;

a first passage surrounded by the heating member; and a second passage formed between a radially outer surface of the heating member and a radially inner surface of the housing and communicating with the first passage;

wherein the outlets communicate with the discharge port via the first passage and the second passage, as well as the housing further comprises a spiral rib protruding from an inner surface of the housing for guiding liquid to flow through the second passage along a spiral path.

21. A heating pump, comprising:

a motor;

a housing fixed to the motor, the housing comprising an axially arranged intake tube and a discharge port arranged at the periphery thereof;

an impeller driven by the motor and received in the housing, the impeller comprising an axially arranged inlet communicating with the intake tube and a plurality of radially arranged, circumferentially spaced, outlets;

a tubular heating member fixed in the housing;

a first passage surrounded by the heating member; and a second passage formed between a radially outer surface of the heating member and a radially inner surface of the housing and communicating with the first passage;

wherein the outlets communicate with the discharge port via the first passage and the second passage, as well as the housing further comprises an end ring partially sealing an axial end of the second passage remote from the motor, and a discharge aperture formed in the end ring, the second passage communicating with the discharge port via the discharge aperture.

22. A heating pump, comprising:

a motor;

a housing fixed to the motor, the housing comprising an axially arranged intake tube and a discharge port arranged at the periphery thereof;

an impeller driven by the motor and received in the housing, the impeller comprising an axially arranged inlet communicating with the intake tube and a plurality of radially arranged, circumferentially spaced, outlets; and a tubular heating member fixed in the housing, the heating member comprises a metal tube, at least one resistor running circumferentially on a radially outer surface of the metal tube, and a sealing element sealing the at least one resistor in a liquid-tight manner, wherein the sealing element comprises a sealing tube that covers the radially outer surface of the metal tube and two axial ends that sealingly contact two axial ends of the metal tube;

a first passage surrounded by the heating member, the outlets communicating with the discharge port via the first passage; and a second passage formed between a radially outer surface of the heating member and a radially inner surface of the housing and communicating with the first passage.

23. A heating pump, comprising:

a motor;

a housing fixed to the motor, the housing comprising a substantially cylindrical lateral wall that is substantially parallel with an axis of the motor and comprises a through hole, an axially arranged intake tube and a discharge port arranged at the periphery thereof;

an impeller driven by the motor and received in the housing, the impeller comprising an axially arranged inlet communicating with the intake tube and a plurality of radially arranged, circumferentially spaced, outlets; and a tubular heating member fixed in the housing, the heating member comprises a metal tube, at least one resistor running circumferentially on a radially outer surface of the metal tube, and a sealing element sealing the at least one resistor in a liquid-tight manner, wherein the sealing element further comprises a extending ring extending from the sealing tube and extending through the through hole, and ends of the at least one resistor are exposed in the extending ring;

a first passage surrounded by the heating member, the outlets communicating with the discharge port via the first passage; and a second passage formed between a radially outer surface of the heating member and a radially inner surface of the housing and communicating with the first passage.

* * * * *